US006183246B1

(12) United States Patent
Le Goueffec

(10) Patent No.: US 6,183,246 B1
(45) Date of Patent: Feb. 6, 2001

(54) METHOD OF HEATING A CONTINUOUSLY CHARGED FURNACE PARTICULARLY FOR STEEL-MAKING PRODUCTS, AND CONTINUOUSLY CHARGED HEATING FURNACE

(75) Inventor: Gérard Le Goueffec, Magny les Hameaux (FR)

(73) Assignee: L'Air Liquide, Societe Anonyme pour l'Etude et l'Exploitation des Procedes Georges Claude, Paris (FR)

( * ) Notice: Under 35 U.S.C. 154(b), the term of this patent shall be extended for 0 days.

(21) Appl. No.: 09/433,934

(22) Filed: Nov. 4, 1999

(30) Foreign Application Priority Data

Nov. 10, 1998 (FR) ..... 98 14127

(51) Int. Cl.[7] ..... F27D 13/00
(52) U.S. Cl. ..... 432/128; 432/11; 432/12
(58) Field of Search ..... 432/11, 12, 14, 432/18, 27, 128, 133, 143, 163, 171, 175

(56) References Cited

U.S. PATENT DOCUMENTS

| | | | | |
|---|---|---|---|---|
| 2,713,480 | * | 7/1955 | Ruckstahl | 432/128 |
| 3,801,267 | * | 4/1974 | Okuno et al. | 432/171 |
| 3,841,614 | * | 10/1974 | Okuno | 432/171 |
| 4,397,451 | * | 8/1983 | Kinoshita et al. | 432/128 |
| 5,482,458 | * | 1/1996 | Kyffin | 432/14 |

FOREIGN PATENT DOCUMENTS

| | | |
|---|---|---|
| 0 184 749 | 6/1986 | (EP) . |
| 0 661 499 | 7/1995 | (EP) . |
| 2 179 532 | 11/1973 | (FR) . |

OTHER PUBLICATIONS

XP–002112852, Database WPI, Week 8549, Derwent Publications Ltd.
XP–002112816, Database WPI, Week 9750, Derwent Publications Ltd.

* cited by examiner

*Primary Examiner*—Denise L. Ferensic
*Assistant Examiner*—Gregory A. Wilson
(74) *Attorney, Agent, or Firm*—Burns, Doane, Swecker & Mathis, LLP

(57) ABSTRACT

The products (1) pass from a charging end (2) to a discharging end (3); at the discharging end side, the furnace exhibits a heating zone (4) equipped with air/fuel burners (41), possibly doped with oxygen, and, on the charging end side, exhibits a flue-gas recuperation or drainage zone (5) in which the flue gases are removed.

At least one fuel body in the gaseous state is incorporated into the flue gases, and oxygen is introduced upstream of that possibly doped air/fuel burner (41) which is situated furthest upstream when referring to the direction of travel of the products (1), so as to burn the gaseous fuel body and thus raise the temperature in the recuperation zone (5).

Possible use for heating steel-making products prior to rolling.

21 Claims, 1 Drawing Sheet

METHOD OF HEATING A CONTINUOUSLY CHARGED FURNACE PARTICULARLY FOR STEEL-MAKING PRODUCTS, AND CONTINUOUSLY CHARGED HEATING FURNACE

BACKGROUND OF THE INVENTION

1. Field of the Invention

The invention relates to the heating of continuously charged furnaces, and in particular to a method of heating furnaces intended to raise to a high temperature, as uniformly as possible, steel-making products which may have a large cross section, for example slabs, billets, blooms or ingots, and to a heating (or reheat) furnace of this kind.

2. Description of the Related Art

The temperature of steel-making products is raised in this way for example so that these products can be rolled, because steel is more malleable at high temperature and better lends itself to the operation.

The furnaces for which this method is intended may be beam-type furnaces, continuous pusher-type furnaces, and rotating-hearth furnaces in particular.

The invention also relates for example to furnaces for carrying out heat treatments "on the fly", particularly for part-finished or finished products (strip, tubes, wire, miscellaneous components).

Ideally, a furnace that performs well is a furnace which delivers a practically uniform temperature with good productivity, forming little scale (or oxides) on the surface, because scale, which is removed just before rolling, corresponds to a significant loss of material, and no adhering scale, thus avoiding the phenomena of "stress cracking" or burning of the products, and which produces a low amount of oxides of nitrogen and carbon dioxide.

The continuously charged furnaces to which the invention pertains generally stretch longitudinally between a product-charging end and a discharging end, the products being conveyed from one end to the other so that they pass right along the internal space of the furnace.

Along this internal space, these furnaces comprise, in succession, zones which fulfil different functions, sometimes immediately identifiable from the existence of internal partitions or particular roof profiles, but sometimes having no distinct physical demarcation.

More specifically, starting from the charging end, conventional furnaces of this type include, first of all, a portion which has no burners, then a portion which has air/fuel burners extending approximately as far as the discharge end.

The portion with burners thus comprises one or more heating zones, for example, from the upstream end in the downstream direction, a preheat zone, a heating zone proper, and an equalization zone near the discharge end from which the heated products are directed towards a rolling installation, for example; the flames developed by the burners allow the products in the furnace to be heated directly or indirectly using heat from the wall of the furnace. The essential method by which heat is transmitted is by radiation in the heating and equalization zones (accounting for more than 90%).

BRIEF DESCRIPTION OF THE INVENTION

It is because combustion at the burners using an oxidizing agent such as air releases a significant volume of flue gases at a high temperature (about 1200° C.), that it has been deemed advantageous to provide, on the charging end side, a burner-free zone in which the flue gases are circulated towards the charging end so that they can be removed, having, in theory, had a high proportion of their energy "drained" on the in-coming cold products. However, although the burner-free port-ion allows a significant amount of the energy present in the flue gases to be used up, it is still advantageous to recuperate these flue gases so that some of their energy can be used to preheat the combustion air, using an appropriate recuperation apparatus.

It may be noted, on the one hand, that the air/fuel ratio is set so that there is a slight excess of air so as to ensure complete combustion and thus avoid any formation of unburnt substances and, on the other hand, that the temperature in the burner-free so-called flue-gas recuperation or drainage zone is markedly lower (900° C. to 1000°) than in the rest of the furnace, which means that the convective-heating contribution in this zone ceases to be negligible (about 30%); at the present time, there is barely any scope for increasing the temperature in this zone because the energy losses would be prohibitive.

SUMMARY OF THE INVENTION

The object of the invention is to overcome this drawback, and the invention therefore consists in a method of heating for raising steel-making products to a high temperature in a furnace of the continuously charged type, in which the products are made to pass from a charging end to a discharging end, this furnace exhibiting at least one heating zone equipped with heating air/fuel burners which may be doped with oxygen but the combustion of which gives off a significant volume of flue gases typical of combustion using air, on the discharge end side, and a so-called flue-gas recuperation or drainage zone, on the charging end side, in the region of which the flue gases are removed, the method being characterized in that at least one fuel body in the gaseous state is incorporated into the flue gases and oxygen gas is introduced upstream of that possibly doped air/fuel burner which is situated furthest upstream when referring to the direction in which the products are made to pass, and at least some of the fuel body in the gaseous state is burnt, thus raising the temperature in the recuperation zone.

By virtue of these features, there are obtained a shift of the heat flux in the furnace in favour of the recuperation zone and, in particular, a reduction in the volume of combustion air, a reduction in the energy developed in the heating and equalization zones, the advantage of additional energy developed in the recuperation zone, a reduction in the volumetric flow of flue gases and, in particular, of the flue gases leaving the furnace, a reduction in the formation of the oxides of nitrogen by virtue of the decrease in the partial pressures of oxygen and of nitrogen and in the temperature in the heating and equalization zones, and better temperature uniformity in the products leaving the heating zone.

The method may additionally exhibit one or more of the following features:

- in order to incorporate at least one fuel body in the gaseous state into the flue gases, at least one air/fuel burner is set to a sub-stoichiometric air/fuel ratio and flue gases containing unburnt substances are produced in the furnace;
- in order to incorporate at least one fuel body in the gaseous state into the flue gases, at least one oxy-fuel burner is set to a sub-stoichiometric oxygen/fuel ratio and flue gases containing unburnt substances are produced in the furnace;

in order to incorporate at least one fuel body in the gaseous state into the flue gases, this fuel body is injected separately from or together with an injection of oxygen into the heating zone or into the inlet to the recuperation zone (in the direction of travel of the flue gases);

oxygen is introduced using at least one means chosen from the following group of means: at least one jet of oxygen is injected, giving it a high impulse perpendicular to the overall direction of the flue gases in the flue-gas recuperation or drainage zone; a series of small jets of oxygen distributed uniformly over a section of the furnace is injected; a series of small jets of oxygen distributed uniformly along the recuperation or drainage zone is injected; at least one jet of oxygen which is made to swirl is injected; at least one top-up oxy-gas burner is set to run super-stoichiometrically;

oxygen is introduced at the inlet to the recuperation zone;

oxygen is introduced into the recuperation zone;

air and fuel are introduced at the burners of the heating zone with a sub-stoichiometric air/fuel ratio corresponding to a value in the range from 0.95 to 0.99;

the air/fuel ratio at the burners of the heating zone is adjusted so that there are no unburnt substances leaving the openings of the furnace;

the pressure is set to a low level, preferably to a depression of a few millimetres' water column;

the oxygen flow rate is set to suit the total rate at which fuel is introduced into the furnace and to suit the combustion ratios chosen;

the amount of at least one of the constituent gases of the flue gases is measured in a flue-gas exhaust pipe or at the inlet thereof, and the flow rate of at least one of the gases introduced into the furnace is adjusted in response to the measurement of the content of this gas in the flue gases;

the oxygen content of the flue gases is measured;

the carbon monoxide content of the flue gases is measured;

the air/gas ratio of the burners is adjusted;

the oxygen/gas ratio for retarded combustion is adjusted;

a stream of fluid is used to cool the oxygen and/or the fuel introduced.

The invention also consists in a heating furnace for raising steel-making products to a high temperature, of the continuously charged type, in which the products pass from a charging end to a discharging end, and exhibiting at least one heating zone equipped with heating air/fuel burners, possibly doped with oxygen, but the combustion of which releases a significant volume of flue gases typical of combustion using air, at the discharge end side, and a so-called flue-gas recuperation or drainage zone at the charging end side in the region of which the flue gases are removed, the furnace being characterized in that it includes devices for incorporating at least one fuel body in the gaseous state into the flue gases and devices for introducing oxygen gas upstream of that possibly doped air/fuel burner which is situated furthest upstream when referring to the direction of travel of the products, so as to burn at least some of the fuel body in the gaseous state and thus raise the temperature in the recuperation zone.

BRIEF DESCRIPTION OF THE FIGURES OF THE DRAWING

Other features and advantages of the invention will emerge from the description which will follow of some methods and forms of embodiment of the invention which are given by way of non-limiting examples.

BRIEF DESCRIPTION OF THE DRAWINGS

Figure 1:
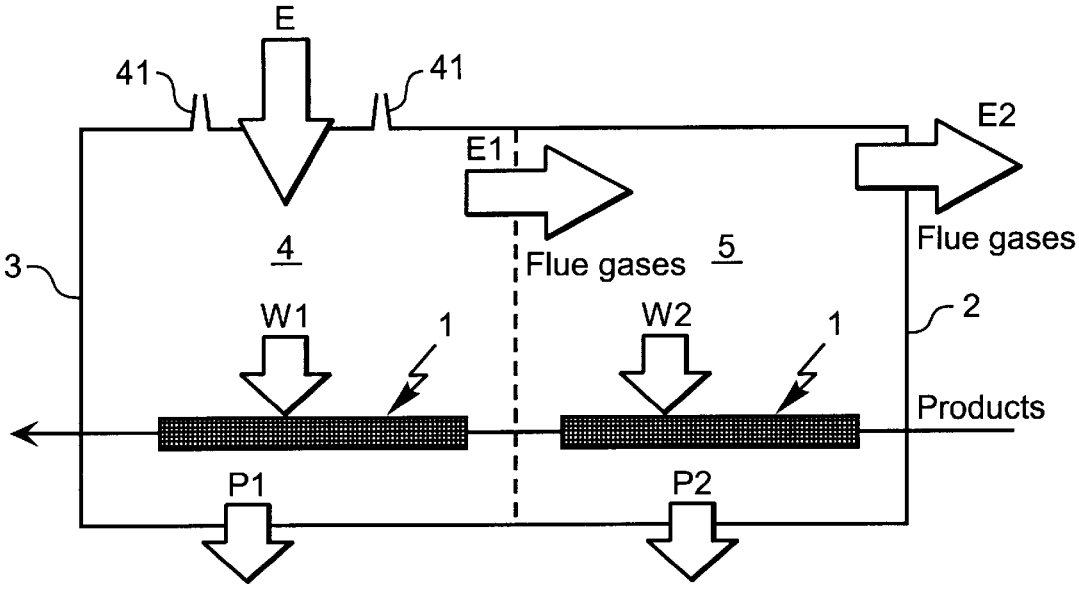
PRIOR ART FIG. 1
Figure 2:
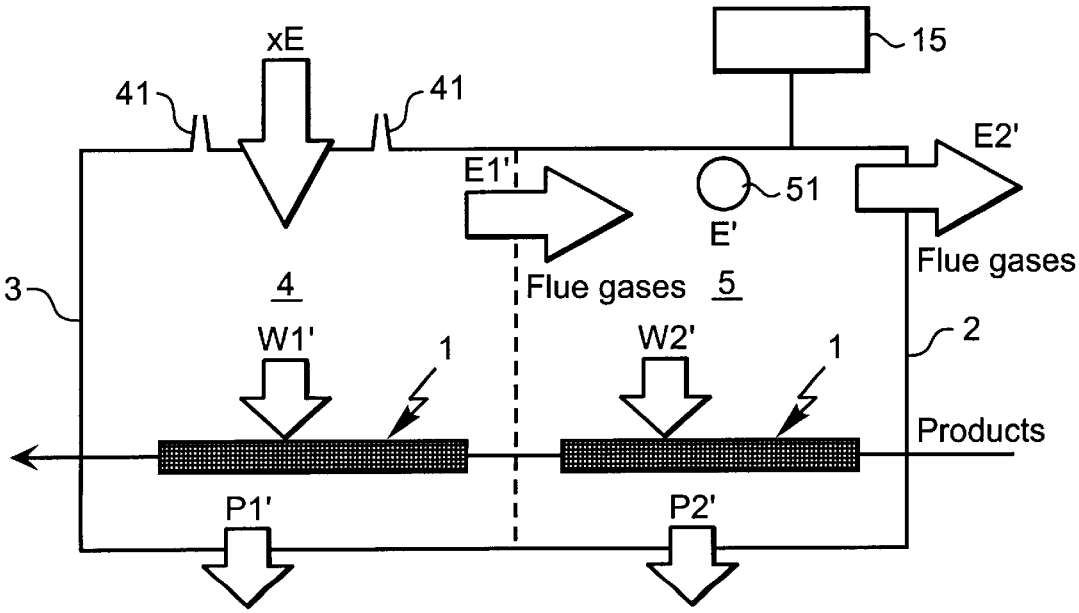

FIG. 1 illustrates the heat balance in a conventional furnace depicted very diagrammatically in longitudinal section, and FIG. 2 illustrates the heat balance in a furnace according to the invention, depicted very diagrammatically in longitudinal section.

DETAILED DESCRIPTION OF THE INVENTION

The conventional continuously charged reheat furnace depicted very diagrammatically in FIG. 1, by means of which steel-making products are raised to a high temperature, includes an internal space in which the steel-making products 1 are made to pass from a charging end 2 to a discharging end 3.

This internal space includes a heating zone 4 equipped with heating air/fuel burners symbolized as 41, on the discharge end side, at which burners, as a result of combustion, high-temperature (of the order of 1200° C.) flue gases are released; the heating zone 4 may itself be subdivided into several zones such as, from the upstream end in the downstream direction, a preheat zone, a heating zone proper, and an equalization zone. The internal space of the furnace also includes a burner-free so-called recuperation or drainage zone 5 in which the hot flue gases released at the burners are circulated so as to recover some of their energy before recuperating them themselves as they leave the furnace in the discharge end region 2 thereof so as to reheat the air sent to the burners.

The term "air/fuel burners" is understood to mean not only conventional air/fuel burners but also air/fuel burners doped with oxygen but nonetheless releasing a significant volume of flue gases typical of combustion using air.

The energies involved in the furnace and symbolized in FIG. 1 by thick arrows are defined as follows:

E=energy entering at the burners 41,

W1=energy transmitted to the products 1 in the heating zone 4,

E1=energy transmitted in the recuperation zone 5,

W2=energy transmitted to the products 1 in the recuperation zone 5,

P1=energy lost through the walls in the heating zone 4,

P2=energy lost through the walls in the recuperation zone 5,

E2=energy removed in the flue gases.

By the laws of the conservation of energy:

$$E-E1=W1+P1,$$

$$E1-E2=W2+P2,$$

$$E-E2=(W1+W2)+(P1+P2).$$

According to the invention, the furnace depicted very diagrammatically in FIG. 2 (in which the elements which are the same as those of FIG. 1 bear the same numerical references) additionally includes, in the flue-gas recuperation or drainage zone 5, devices 51 for introducing oxygen. By virtue of the fact that oxygen is introduced, it is possible to employ retarded combustion, by means of which the temperature in this zone is raised; to this end, the gases introduced at the air/fuel burners 41 (which may have been doped with oxygen) in the heating zone 4 are metered in such a way that the air/fuel ratio is at a sub-stoichiometric level so that the flue gases produced which are made to enter the recuperation zone contain unburnt substances capable of reacting with the oxygen.

It should be noted that setting the air/fuel burners 41 to a sub-stoichiometric air/fuel ratio is merely one example of means for incorporating a fuel body in the gaseous state (in this case, unburnt substances) into the flue gases and that, as an alternative, it would be possible to provide one or more oxy-fuel burners set to a sub-stoichiometric oxygen/fuel ratio in the heating zone or to inject a fuel into the heating zone or into the inlet of the recuperation zone (in the direction of flow of the flue gases) using a fuel injector.

Likewise, oxygen may be introduced using oxygen-introducing devices 15 as here right into the flue-gas recuperation zone 5 or into the inlet of this zone 5 (when considering the direction of travel of the flue gases coming from the heating zone 4) or even near to this zone, that is to say, in the most general case, upstream of that heating air/fuel burner 41 of the heating zone 4 which is furthest upstream when referring to the direction of travel of the products 1 through the furnace (from the charging end 2 to the discharging end 3).

Depending on the conditions in the furnace, and in particular on the exposure to radiation therein, it is possible to cool the devices for introducing oxygen and/or fuel, for example using air, nitrogen or water.

Here, as a preference, the air/fuel ratio is set to a sub-stoichiometric level corresponding to a value in the range from 0.95 to 0.99. This ratio is adjusted for each furnace so that there are no unburnt substances leaving the openings of the furnace. The pressure is set to a very low level, possibly to a slight depression (of a few millimetres' water column).

The flow rate of oxygen itself is regulated according to the total flow rate of fuel gas that is to be injected into the furnace and the combustion ratios chosen.

For this, the furnace is advantageously equipped with regulating apparatus (not depicted); this apparatus includes at least one probe by means of which the oxygen and/or carbon monoxide content of the flue gases leaving the furnace is measured, for example in an exhaust pipe, and a regulating device by means of which one of the air/gas ratios of the burners or the oxygen/gas ratio for retarded combustion is regulated.

By virtue of this optimization, which ultimately ensures complete combustion of the unburnt substances, excessive product oxidation and/or excessive oxygen consumption is/are avoided.

From the practical viewpoint, the introduction devices 51 by means of which the oxygen is introduced have to be designed in such a way that the oxygen can be made to react quickly with the unburnt species in the furnace environment. These introduction devices may consist of one or more similar or different items of apparatus, such as:

- one or more lances by means of which at least one jet of oxygen is injected, giving it a high impulse perpendicular to the overall flow of flue gases (overall direction of the flue gases in the recuperation zone),
- a series of small lances by means of which a series of small oxygen jets distributed uniformly over a section of the furnace is injected,
- a series of small lances by means of which a series of small oxygen jets distributed uniformly in the recuperation chamber, along the latter, is injected,
- one or more lances by means of which a small jet of oxygen which is made to swirl is injected (so-called swirl-effect lances),
- one or more high-impulse top-up oxy-gas burners which are set to operate very super-stoichiometrically, and by means of which additional oxygen and additional energy is provided and which do not generate very many flue gases, which burners are arranged in the lateral walls or in the roof of the furnace.

If the furnace of FIG. 2 is compared with that of FIG. 1, by analogy with furnaces in other technical fields, there are a certain number of valid approximations and assumptions that can be made.

To a first approximation, it may be estimated that the temperature of the flue gases removed at the outlet of the furnace is almost identical. In point of fact, these flue gases are slightly hotter, as a result of the combustion using oxygen, but have a longer residence time (reducing the volume of flue gases); at the ambient temperatures of this zone, heat exchanges are still predominantly by radiation, and so the energy drained from the flue gases is proportional to this time; this assumption may also be applied to the flue gases leaving the zones which have burners.

The losses through the walls may be considered as being identical.

If the same energy balance technique and the same notations as were used in FIG. 1 are applied to the furnace of FIG. 2, and if x is the combustion ratio chosen for the zones which have burners (x=1 being the perfect stoichiometric ratio), then the energies involved are defined as follows:

- xE=energy entering at the burners 41,
- W1'=energy transmitted to the products 1 in the heating zone 4,
- E1'=xE1=energy transmitted in the recuperation zone 5,
- W2'=energy transmitted to the products 1 in the recuperation zone 5,
- P1'=P1=energy lost through the walls in the heating zone 4,
- P2'=P2=energy lost through the walls in the recuperation zone 5,
- E'=(1−x)E=energy given up by the combustion of oxygen from the introduction means 51 in the recuperation zone 5,
- E2'=xE2=energy removed in the flue gases.

Taking the above into consideration, the conservation of energy equation in the recuperation zone can be written thus:

$$xE1+(1-x)E-xE2=W2'+P2,$$

instead, in the first scenario, of:

$$E1-E2=W2+P2;$$

by subtraction:

$$W2'-W2=(1-x)[E-(E1-E2)].$$

Thus, the energy transferred to the product in the energy recuperation zone has been increased.

The equation in the heating zone can be written:

$$xE=xE1=W1'+P1,$$

instead, in the case of 100% air, of:

$$E-E1=W1+P1.$$

By subtraction:

$$W1'-W1=(1-x)[E-E1].$$

The energy transferred to the product has therefore decreased slightly in the heating and equalization zones.

The total energy transferred to the product is:

$$(W1'+W2')-(W1+W2)=(1-x)E2.$$

This result observes the theory of combustion with oxygen: the term (1−x)E2 precisely corresponds to the reduction in energy lost by the flue gases as a result of the reduction in the volume of the flue gases leaving the furnace. The extra energy can be put to use to reduce the consumption of fuel gas or to increase the production rate.

The energy in the furnace is therefore distributed in a fundamentally different way, and the physico-chemical properties of the atmosphere are altered significantly.

In the combustion zone, as a sub-stoichiometric setting is used:

- the flue gases generated do not contain oxygen but, on the other hand, contain reducing species (CO, $H_2$ in particular),
- the flame temperature is reduced slightly,
- the flue gases conserve residual potential energy.

At the outlet from the heating zones or directly at the recuperation zone, the unburnt substances are consumed by retarded combustion with oxygen, and better transfer of energy to the product in this zone is thus achieved without causing an increase in outlet temperature. By virtue of the fact that the volume of flue gases is reduced, the energy lost in these flue gases is also reduced.

Furthermore, the product is heated far earlier, and, as has been seen, by virtue of the reduction in the volume of flue gases, additional energy by means of which production can be increased or the energy consumption reduced becomes available.

This results in a number of technical advantages, some of which may be quantified.

Thus, the productivity of the furnace may be improved; specifically, if the potential energy (1−x)E2 is used to reduce the incoming fuel-gas energy, then the gain in productivity is:

$$G_{productivity}=1-[E-(1-x)E2]/E$$

$$G_{productivity}=(1-x)E2/E\times 100 \text{(value expressed in \%)}.$$

This energy can also be used by increasing production; specifically, by virtue of this injection technology, the installation has no particular thermal limit, because:

- the flow rates of fuel gas are not increased,
- the most critical temperatures in the furnace (in the very hot zones) are not affected and, by contrast, the flame temperatures are lowered slightly,
- as the products are heated earlier, it is possible to achieve better transfer to the core of these products and the time spent in the equalization zone is thus reduced.

The increase in production can be estimated as:

$$G_{production}=(1-x)E2/(W1+W2)\times 100 \text{(value expressed in \%)}.$$

Furthermore, the $CO_2$ production is reduced because, for constant production, the gain in productivity Gproductivity calculated earlier corresponds to a reduction in energy consumption per tonne of steel and the production of $CO_2$ follows exactly the same law:

$$C_{productivity}=G_{productivity}.$$

In the same way, the increase in production for the same fuel consumption makes it possible to calculate a reduction in the amount of $CO_2$ emitted per tonne:

$$C_{production}=1/(1-G_{production})-1\neq G_{production}.$$

In parallel, the emissions of the oxides of nitrogen are reduced because the production of these oxides in a flame is essentially associated with the flame temperature and its stoichiometry; now, in the technique employed, as the flame used is sub-stoichiometric, the flame temperature is slightly reduced and, because of the reducing nature of the flame, the production of the oxides of nitrogen is, to a large extent, discouraged; what is more, in the recuperation zone, the temperatures are not raised high enough to generate oxides of nitrogen. The result is that this technique is significantly different from the conventional doping techniques in which relatively significant nitrogen oxide emissions are produced.

Furthermore, the temperature of the products is made more uniform. Now, certain grades of steel or certain steel-making formats require good temperature-uniformity of the product as it leaves the furnace; early heating of the product is an important factor in achieving this objective because, in part-finished products, the thickness and conductivity are not insignificant and the "core" is often colder than the "skin" upon leaving the furnace; the method and the furnace according to the invention encourage heat transfer to occur earlier on in the reheat cycle, and the limitation by conduction in reheat is markedly reduced.

For example, in a conventional so-called "continuous pusher-type" furnace, through the bottom of which is circulated a bed of steel alloy part-finished products about twelve centimetres thick to which a uniform flux per unit area of 150 kW/$m^2$ is applied, the part-finished products enter the heating zone at a uniform temperature of 500° C. and reach the temperature of 1050° C. midway through their thickness after 2450 seconds, whereas in an equivalent furnace set out according to the invention, the part-finished products enter the heating zone at about 600° C. and, thanks to the good use made of the heat in the recuperation zone, reach the temperature of 1050° C. midway through their thickness after 1780 seconds.

It is thus possible to reduce product defects, because some of the metallurgical defects observed in the heated products are due to local overheating, and using the technique of retarded combustion the products are heated more uniformly and the thermal stresses are reduced throughout the reheat cycle; what is more, as the flame temperatures are reduced, the risk of overheating by flames which are too close to the product is also reduced.

Using the invention, it is therefore possible either to reduce the core-skin differences for constant production, or to reduce the duration of the treatment in the furnace.

The losses at red heat due to surface oxidation of the products are also reduced to an appreciable extent. These losses may represent between 0.5% to 1.5%; the oxidation which causes it is essentially associated with the oxidizing species present in the furnace, namely $O_2$ and $CO_2$ in particular; this oxidation is all the greater, the hotter the product. The technique according to the invention makes it possible to use a reducing setting in the hot zones, and to supplement with oxidizing oxygen up to the stoichiometric amount while the product is not yet very hot; the scale formed is therefore reduced because for a large proportion of the cycle, the product is in contact with an atmosphere that is less aggressive in terms of oxidation. The reducing setting is made possible by the retarded combustion with oxygen, the use in the recuperation zone allowing additional heat to be transferred to the charge as mentioned hereinabove; by contrast, retarded combustion with air would lead to increased flue-gas losses. It can be seen that this technique differs from conventional doping techniques (overall doping or lance doping) which could be envisaged in such furnaces and which themselves would not alter the atmosphere in contact with the product.

Another problem posed by the scale is that of preventing the scale from sticking; this phenomenon is encountered with highly alloyed products, such as, for example, special steels or stainless steels; it is due to the combination of migrations of certain elements of the alloy between the base metal and the scale, to the thickness of the scale and to surface overheating of the product; locally, eutectic mixtures are formed and, under the action of temperature, these mixtures become molten; this results in strong adhesion of the scale at these points. Using the invention, it is possible to influence both the thickness of the scale and the existence of very hot spots which are due to burning. The risk of adherent scale is thus reduced.

Finally, as the burners are being used sub-stoichiometrically, the flame temperature is reduced slightly and the operating difficulties associated with hot spots in the furnace are therefore less critical.

What is claimed is:

1. A method of heating steel-making product to a high temperature in a continuously charged furnace, comprising passing the products from a charging end to a discharging end, said furnace including at least one heating zone equipped with air/fuel burners employed for burning, said burners being capable of being doped with oxygen;

incorporating into one or more flue gases at least one fuel body in gaseous state;

supplying oxygen gas upstream of said air/fuel burners; and burning the fuel body in said gaseous state in a flue-gas recuperation/drainage zone, wherein the temperature is raised.

2. The method according to claim 1, further comprising adjusting the air/fuel ration in said burners to sub-stoichiometric oxygen/fuel ratio, and producing flue gases containing unburnt substances in the furnace.

3. The method according to claim 1, further comprising incorporating at least one fuel body in gaseous state into the flue gases by setting at least one oxy-fuel burner to sub-stoichiometric oxygen/fuel ratio, and producing flue gases containing unburnt substances in the furnace.

4. The method according to claim 3, further comprising incorporating at least one fuel body in gaseous state into the flue gases, wherein the fuel body is injected separately from or together with oxygen into said heating zone or into the inlet of said recuperation zone.

5. The method according to claim 1, further comprising introducing the oxygen by at least one jet of oxygen providing a high impulse perpendicular to the overall direction of the flue gasses in said flue-gas recuperation/drainage zone.

6. The method according to claim 1, further comprising introducing the oxygen through a series of small jets of oxygen distributed uniformly over a section of said furnace.

7. The method according to claim 1, further comprising introducing the oxygen by swirling the jet of oxygen injected.

8. The method according to claim 1, wherein at least one top-up oxy-gas burner is set to run super-stoichiometrically.

9. The method according to claim 1, further comprising introducing the oxygen at the inlet of said recuperation zone.

10. The method according to claim 1, further comprising introducing the oxygen in the recuperation zone.

11. The method according to claim 1, further comprising introducing the air and fuel at the burners of the heating zone with a sub-stoichiometric air/fuel ratio corresponding to a value in the range of 0.95 to 0.99.

12. The method according to claim 1, further comprising adjusting the air/fuel ratio at the burners of said heating zone in order to eliminate the unburnt substances leaving the openings of said furnace.

13. The method according to claim 1, wherein the pressure is set to a low level.

14. The method according to claim 13, wherein the pressure is set to a depression of a few millimeters' water column.

15. The method according to claim 1, further comprising setting the oxygen flow rate to suit the total area at which fuel is introduced into the furnace and to suit the combustion ratio chosen.

16. The method according to claim 1, wherein the amount of at least one of the constituent gases in the flue gasses is measured in a flue exhaust pipe or at least at an inlet thereof, and the flow rate of at least one of the gases introduced into said furnace is adjusted in response to the measurement of the content of this gas in the flue gasses.

17. The method according to claim 1, further comprising measuring the oxygen content of the flue gases.

18. The method according to claim 1, further comprising measuring the carbon monoxide of the flue gases.

19. The method according to claim 1, further comprising adjusting the air/gas ratio for retarded combustion.

20. The method according to claim 1, wherein a stream of fluid is used to cool the oxygen and/or fuel introduced.

21. A heating furnace for heating a steel-making product to a high temperature in a continuously charged furnace, comprising a charging and a discharging end, wherein at least one heating zone is disposed therebetween, said heating zone being equipped with air/fuel burners employed for burning and said burners being capable of being doped with oxygen;

a fuel-recuperation/drainage zone disposed toward the discharge end where flue gases are removed; and devices for incorporating at least one fuel body in the gaseous state into the flue gases disposed toward the discharging end and devices for introducing oxygen upstream of the air/fuel burners to burn at least some of the fuel body in the gaseous state and raise the temperature in the flue-recuperation/drainage zone.

* * * * *